US006265964B1

(12) United States Patent
Payne

(10) Patent No.: US 6,265,964 B1
(45) Date of Patent: Jul. 24, 2001

(54) AUTOMATED BUILDING ACTIVATION SYSTEM

(76) Inventor: Brian Payne, 37 Place de Bohéme, Candiac Québec (CA), J5R 3N2

( * ) Notice: Subject to any disclaimer, the term of this patent is extended or adjusted under 35 U.S.C. 154(b) by 0 days.

(21) Appl. No.: 09/275,047

(22) Filed: Mar. 24, 1999

(51) Int. Cl.[7] ..... G08B 1/00

(52) U.S. Cl. ..... 340/286.01; 340/825.31; 340/506; 340/825.06

(58) Field of Search ..... 340/286.01, 506, 340/541, 309.15, 825.06, 825.3, 825.31

(56) References Cited

U.S. PATENT DOCUMENTS 4,532,507 * 7/1985 Edson et al. ..... 340/825.31
5,801,625 * 9/1998 Wang ..... 340/506
5,872,513 * 2/1999 Fitzgibbon et al. ..... 340/539

* cited by examiner

*Primary Examiner*—Daryl Pope
(74) *Attorney, Agent, or Firm*—Shlesinger, Arkwright & Garvey LLP

(57) ABSTRACT

There is provided a new and useful system for activating building facilities in the case of an emergency in which the system comprises an activation means to allow emergency personnel to selectively access the system. There is further provided a plurality of adjustable timer circuits, each of which timer circuit is arranged so that the system controls a respective one or more of the building facilities for a predetermined period of time, and a microprocessor to control the timer circuits. In the case of an emergency, the emergency personnel access the system for a first cycle by activating the activation means whereby the system assumes control of the building facilities during the first cycle

19 Claims, 3 Drawing Sheets

NC ⑧
C ⑦
ND ⑨
Q3
2N3904
R4
10K
S2
S1
RP1
10K
D7
D8
D9
D10
D11
D12
D13
D14
D15
D16
D17
D18
D19
D20
D21
D22
VCC
RS
1K
D23
JN914
D52
Q2
1K
RP2
1/4
VCC
U1
PIC 16C54RC/P
RB0
RB1
RB2
RB3
RB4
RB5
RB6
RB7
RA0
RA1
VDD
VSS
MCLR
RTCC
OSC1
OSC2
RA2
RA3
C2
(V1)
.1
RP1
10K
C3
1UF
D5
R1
32.4
1%
D1
5.1V
C4
22 PL
C5, 22.PB
D4
IN914
RL1
1K
RP2
DS1
Q1
2N3904
VDD
1K
RD2
R3
10K
D3
VDD
R2
470R.1/2W
C1
22UF
35V
VCC
D2
12/24V
0V
NC
C
ND

AUTOMATED BUILDING ACTIVATION SYSTEM

FIELD OF THE INVENTION

This invention relates to a system for activating building facilities in the case of an emergency.

BACKGROUND OF THE INVENTION

A quick glance over any urban skyline will reveal a large number of multi-story and high-rise buildings. Most of these multi-unit buildings, such as office buildings and apartment buildings have various electric or electronically controlled facilities, such as the elevator(s), the security doors and the emergency warning alarm system. Although generally designed with safety concerns in mind, these facilities often hinder emergency service personnel who are called to respond to an emergency at the building.

Until the present, there has been no successful attempt to facilitate the rapid access of emergency services personnel into such office and apartment buildings. Rather, the security doors and elevators typically slow down emergency response time to the incident.

For example, an emergency service unit responding to an incident at such a building must request the security door to be opened which quite often absorbs a lot of time for any number of reasons. Once past the security door, the emergency personnel must wait for the elevator to come to the ground floor, which again can absorb a lot of precious time, especially in some of the larger office towers in the large urban centres. These delays have been found to be between three and twenty minutes.

There thus exists a need for a system which could be used by emergency services personnel to provide automated rapid access into the building and to the building facilities for a limited period of time, after which the facilities would return to their normal operating state.

A further requirement is for there to be a universal means of accessing the building facilities at a number of different buildings. Rather than requiring emergency personnel to carry an assortment of keys, access codes or the like, it is desirable to have a single, universal alternative which emergency personnel can use at any building within the assigned territory for those personnel to access the facilities of those buildings.

SUMMARY OF THE INVENTION

It is thus an object of the present invention to provide a system for activating building facilities in the case of an emergency.

In one aspect of the invention there is provided a system for activating building facilities in the case of an emergency in which the system comprises an activation means to allow emergency personnel to selectively access the system. There is further provided a plurality of adjustable timer circuits, each of which timer circuit is arranged so that the system controls a respective one or more of the building facilities for a pre-determined period of time, and a microprocessor to control the timer circuits. In the case of an emergency, the emergency personnel access the system by activating the activation means whereby the system assumes control of the building facilities during a cycle.

In another aspect of the invention, the building facilities comprise an alarm system, at least one security door and at least one elevator, wherein in use, the system actuates the alarm system, unlocks the at least one security door and calls the at least one elevator to the ground floor of the building.

In another aspect of the invention, the system comprises three timer circuits, one wired to control the alarm system and the at least one security door for a first period of time, one wired to control the at least one elevator for a second period of time and one wired to act as a delay period to allow the affected building systems to reset before the system can be re-started.

In another aspect of the invention, there is provided a security means to access the system and prevent unauthorized access to the system.

In another aspect of the system there is provided a plurality of systems for activating building facilities at a plurality of buildings wherein each of the systems is located at a different respective building and one security key provides universal access to each of the systems.

BRIEF DESCRIPTION OF THE DRAWINGS

These and other advantages of the invention will become apparent upon reading the following detailed description and upon referring to the drawings in which:—

Figure 1:
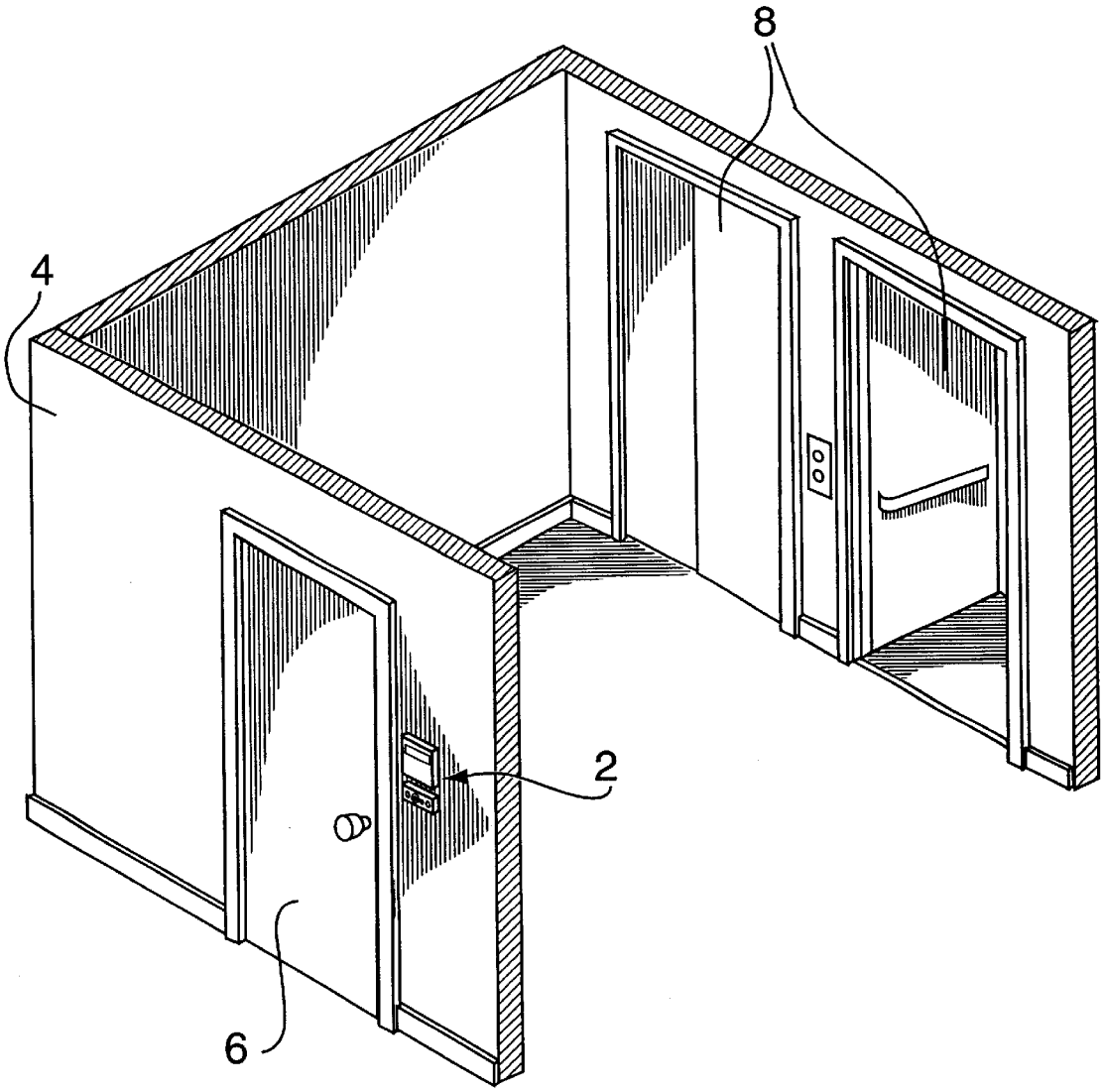
FIG. 1 is a perspective view of the system of the present invention, in an example installation on a building.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates an example installation of the system 2 on a building 4. As illustrated, the building 4 contemplated for use with the present invention comprises some standard facilities including a security door 6 and a bank of one or more elevators 8. Most buildings are also equipped with an audible security alarm system (not shown). The system 2 is to be located at the building 4 in a location accessible to emergency personnel.

With reference to FIGS. 2 to 5, an example embodiment of the structure of the system 2 will be described, although it will be appreciated by those skilled in the art that the specific circuitry and wiring of the system need not be exactly as illustrated in order to effect the desired result.

Figure 2:
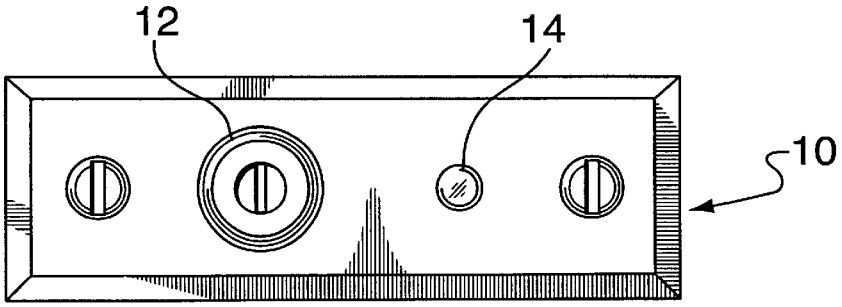
FIG. 2 is a front elevation of the access control portion of the present invention.

FIG. 2 illustrates the control portion 10 of the system 2 which will be accessed by the emergency personnel. The control portion 10 comprises an activation means 12 which is selectively activated by those emergency personnel. The activation means 12 is preferably a security device in the form of an Abloy™ lock and key set which provides authorized access but also prohibits unauthorized access. There is further provided an indicator 14 to advise the personnel that the system is activated.

The system 2 further presents as a circuit board 20 with a plurality of dip switches 22 for defining preferably three timer circuits 24, 26 28 corresponding to three delay cycles. Switches 1 to 3 (as labelled on FIG. 3) control the first timer circuit cycle, delay 1, which is between 0 and 35 seconds and is preferably programmed to be about 8 seconds. Switches 4 to 9 control the second timer circuit cycle, delay 2, which is between 0 and 63 seconds and is preferably programmed to be between 15 and 63 seconds. Switches 10 to 15 control the third timer circuit cycle, delay 3, which is between 0 and 63 seconds and is preferably programmed to be between about 30 and 60 seconds. The last dip switch, switch 16 is programmed to select between 12 volts DC and 24 volts DC for the system.

Figure 3:
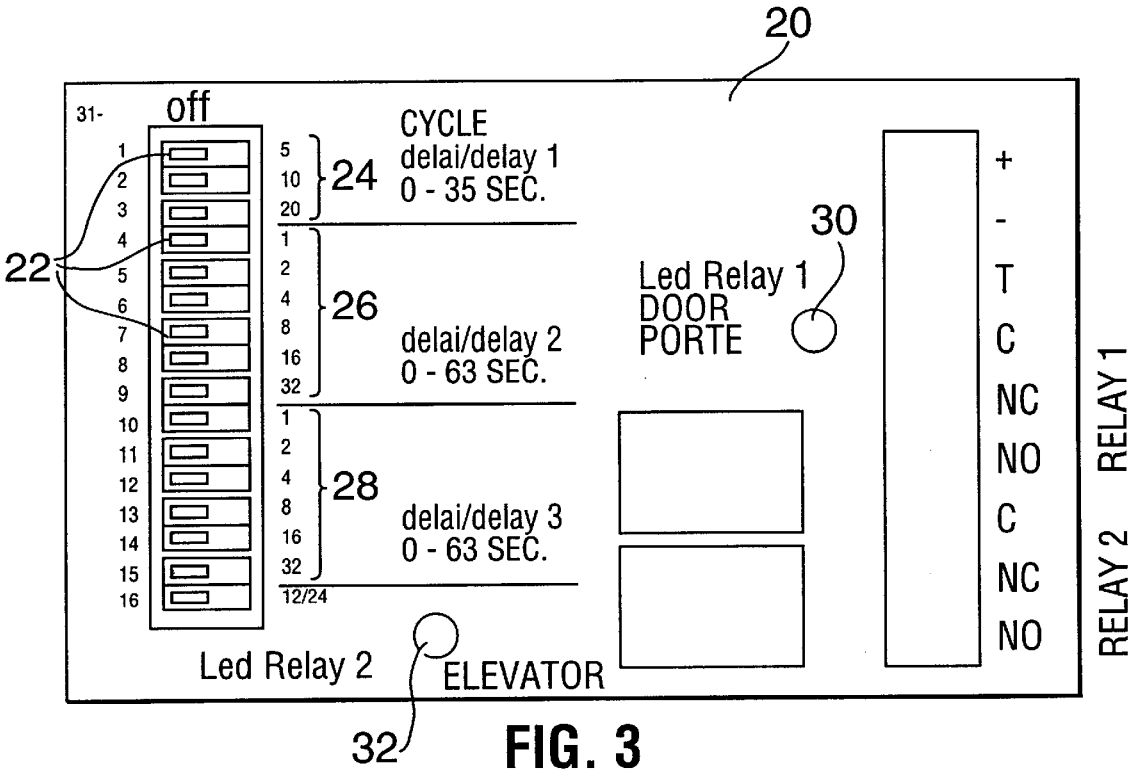
FIG. 3 is a plan view of the circuit board of the system of the present invention.
Figure 4:
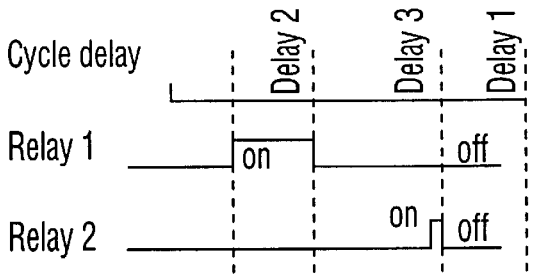
FIG. 4 is a cycle diagram of the system of the present invention.
Figure 5:
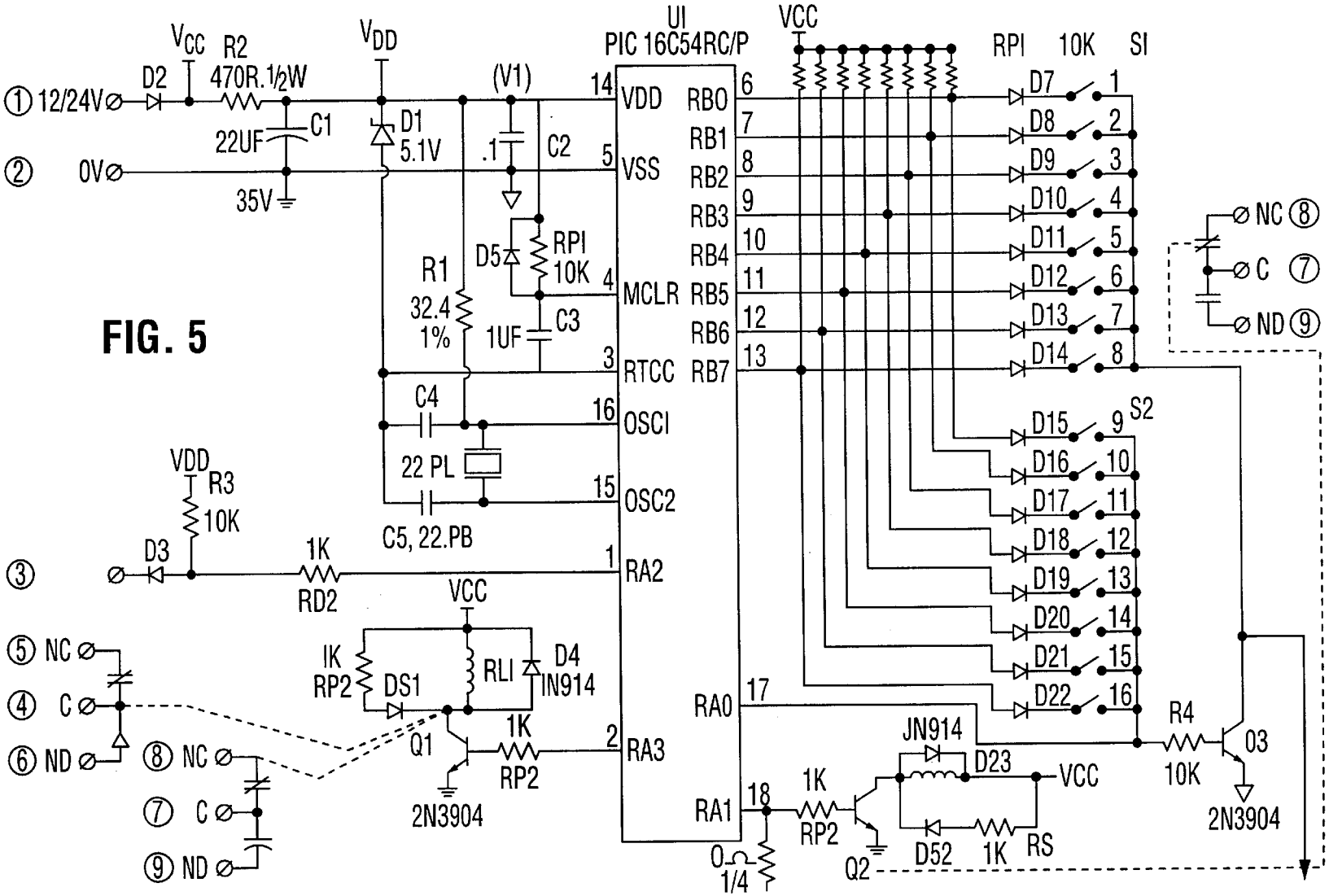
FIG. 5 is a circuit diagram of one embodiment of the system of the present invention.

The circuit board further comprises a first indicator 30, preferably in the form of an LED, to advise if the delay 2 cycle is operable and a second indicator 32, again preferably in the form of an LED, to advise of the delay 3 cycle is operable. As illustrated in FIG. 3, and in the cycle diagrams of FIG. 4, the first indicator 30 is devoted to advise as to the status of the security door 6 or other use, as required and the second indicator 32 is devoted to advise as to the status of the elevators 8 or other use, as required.

As discussed above, the circuit diagram of FIG. 5 is a representative example or circuitry of the present system controlled by a microprocessor and incorporating the three timer circuits. Such modifications as would be apparent to the person skilled in the art to enable the system to function in the manner described herein are intended to fall within the scope of the present invention.

In operation, the emergency personnel, such as fire, police or emergency health services would be called to the building. Upon arriving at the building, rather than waiting for the building superintendent or some other building representative to provide access, the emergency personnel would have a system access device, such as a key which is universal for a given geographic region and which will therefore allow access to all buildings equipped with the present system within that region. The security access device will be used to activate the system so as to allow the system to take control of the pre-defined building facilities for the pre-determined time periods. Specifically, the three timer circuits illustrated as part of the preferred embodiment of the present invention will control the security door 6, the elevators 8 and the security alarm (not shown) by having the system 2 wired into the wiring of the building 4 in a conventional fashion. This control will last for a first cycle of time, preferably about 8 seconds for the security 6, preferably about 8 seconds for the security alarm to alert the building staff the emergency personnel have activated the system and have entered the building, and preferably between about 30 and 60 seconds for the elevators. This third period of time will depend largely on the size of the building and the speed of the elevators but it is to be understood that the timer circuit is to be programmed so as to give the elevators sufficient time to return to the lobby or ground floor from the current position within the building.

Once each of these times has elapsed, the building facilities will return to normal operating mode, unless the system 2 is activated again during this first cycle of activation. In that event, a second cycle is commenced and the first and second periods of time, namely the time for which the security alarm and the security door are controlled, are extended to equal the third period of time, namely the elevator activation time.

It will be further appreciated that the system may be extended to include other building facilities as required by extending the number of timer circuits within the system or programming the timer circuits to control more than one of the building facilities at one time.

Thus, it is apparent that there has been provided in accordance with the invention an automated building activation system that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A system for allowing emergency personnel access to a building, and building facilities such as an elevator and security system, during an emergency, said system comprising:

manually operable activation means accessible to the emergency personnel to activate said system;

a plurality of adjustable timer circuits, each arranged to control a respective one of a plurality of building facilities for a pre-determined period of time so that when said activation means is activated, said system assumes control of the building facilities for a first cycle to allow the emergency personnel access to the building, and its facilities; and a microprocessor to control said time circuits.

2. The system as in claim 1, wherein:

said activation means includes a control switch located at the building and accessible to the emergency personnel.

3. The system as in claim 2, and further comprising:

a security key operable with said control switch.

4. The system as in claim 1, and further comprising:

a status indicator operably connected to said activation means to indicate to the emergency personnel when said activation means is activated.

5. The system as in claim 1, wherein:

one of said timer circuits is to be connected to an alarm system and a security door so that when said activation means is activated, the alarm system is actuated and the security door is unlocked during a first delay period.

6. The system as in claim 1, wherein:

one of said timer circuits is to be connected to an elevator so that when said activation means is activated, the elevator is called to a pre-determined floor during a second delay period.

7. The system as in claim 1, wherein:

one of said timer circuits provides a third delay period to allow the building facilities to reset before said system can be restarted.

8. The system as in claim 5, wherein:

said first delay period is 0–63 secs.

9. The system as in claim 5, wherein:

said first delay period is about 8 secs.

10. The system as in claim 6, wherein:

said second delay period is 0–63 secs.

11. The system as in claim 6, wherein:

said second delay period is 30–60 secs.

12. The system as in claim 7, wherein:

said third delay period is 0–35 secs.

13. The system as in claim 1, wherein:

each of said timer circuits includes a relay circuit.

14. The system as in claim 13, wherein:

each relay circuit includes a status indicator.

15. The system as in claim 1, and further comprising:

a voltage selector to select between 12 VDC and 24 VDC.

16. The system as in claim 1, wherein:

said activation means when activated during said first cycle starts a second cycle wherein the pre-determined period of time of some of said timer circuits is extended.

17. A system for allowing emergency personnel access to any one of a plurality of buildings, and building facilities such as an elevator and security system, during an emergency, said system comprising:

a sub-system associated with each of a plurality of buildings;

said sub-system including a manually operable activation means accessible to the emergency personnel to activate said sub-system;

a plurality of adjustable timer circuits, each arranged to control for a pre-determined period of time a plurality of building facilities associated with the building to which access is desired so that when said activation means is activated, said sub-system assumes control of the building facilities for a first cycle to allow the emergency personnel access to the building, and its facilities; and a microprocessor to control said timer circuits.

18. The system as in claim 17, wherein:

said activation means includes a control switch located at each building and accessible to the emergency personnel.

19. The system as in claim 18, and further comprising:

a universal security key operable with each control switch.

* * * * *